United States Patent [19]

Sherwood

[11] 4,238,162

[45] Dec. 9, 1980

[54] NIB RETAINING ASSEMBLY FOR A WRITING INSTRUMENT

[75] Inventor: Edward E. Sherwood, Wheaton, Ill.

[73] Assignee: Sanford Research Company, Bellwood, Ill.

[21] Appl. No.: 897,635

[22] Filed: Apr. 17, 1978

[51] Int. Cl.[3] ..... B43K 3/00; B43K 8/02

[52] U.S. Cl. ..... 401/198; 401/207

[58] Field of Search ..... 401/23, 196, 198, 199, 401/202, 205, 206, 223, 224, 207

[56] References Cited

U.S. PATENT DOCUMENTS

| | | | |
|---|---|---|---|
| 3,003,182 | 10/1961 | Rosenthal | 401/199 X |
| 3,325,851 | 6/1967 | Roller, Sr. | 401/198 |
| 3,397,938 | 8/1968 | Juelss | 401/198 |
| 3,421,823 | 1/1969 | Matsumoto | 401/199 |
| 3,446,563 | 5/1969 | Burnham | 401/199 |
| 3,468,613 | 9/1969 | Strickler | 401/199 |
| 3,767,520 | 10/1973 | Dick et al. | 401/196 X |
| 3,776,646 | 12/1973 | Bich | 401/199 |
| 3,881,828 | 5/1975 | Jones | 401/199 |
| 3,932,044 | 1/1976 | Otake et al. | 401/199 X |
| 3,972,629 | 8/1976 | Whalen, Jr. | 401/199 |

FOREIGN PATENT DOCUMENTS

| | | | |
|---|---|---|---|
| 2016401 | 10/1971 | Fed. Rep. of Germany | 401/199 |
| 1439018 | 4/1966 | France | 401/196 |

*Primary Examiner*—Steven A. Bratlie

*Attorney, Agent, or Firm*—Wegner, Stellman, McCord, Wiles & Wood

[57] ABSTRACT

A nib retaining assembly for a writing instrument to hold a capillary writing element or nib of small cross-sectional dimension in position against writing pressure, the nib retaining assembly including a nib receiving main longitudinal passageway formed by offset portions through which the capillary element extends. The capillary element is held by light staking within an axial bore of a nib holder which, in turn, is inserted into a seat at one end of the passageway. Because of the passageway offset portions and an intermediate camming surface, a capillary element inserted into the passageway is deflected around an internal shoulder so as to be forced into frictional engagement with the passageway walls to hold the small nib in writing position without disturbing the capillary action. In one embodiment of the invention, the passageway is defined by a nib retaining adapter inserted into a seat in the barrel; while in another embodiment the passageway is defined by the tubular barrel of the instrument. A single nib retaining assembly will accommodate nibs of many different diameters.

11 Claims, 11 Drawing Figures

NIB RETAINING ASSEMBLY FOR A WRITING INSTRUMENT

BACKGROUND OF THE INVENTION

This invention relates generally to writing instruments in which ink or other writing fluid flows through a capillary element and, more particularly, to a means for preventing movement or retraction of the capillary element into the barrel of the writing instrument when subjected to writing pressures.

Writing instruments having a tubular barrel, an internal ink reservoir and a capillary plastic or fiber nib through which ink is transferred from the reservoir to a writing surface are well known in the art. The nibs are typically held in place by crimping or deforming the ferrule portion of the barrel onto the nib. Oftentimes, a separate nib holder is utilized, the nib holder being inserted into a seat at the open end of the barrel. The nib holder is staked or dimpled to hold the nib so that it will not be pushed into the barrel while in use. The staking or dimpling must be sufficient to properly hold the nib, but cannot be too deep so as to disrupt the capillary flow through the minute capillary conduits of the nib. Because of the small dimensions involved with such assemblies, the degree of dimpling or staking was heretofore critical. If the nib was not adequately staked, the nib would often push up into the nib holder preventing further writing; if the nib was staked too deep, the flow of ink through the capillary conduits of the nib was often blocked or partially blocked which interfered with a writing operation.

It is therefore highly desirable to find a convenient and inexpensive means for holding such small capillary nibs in firm writing position without interfering with the capillarity of the nibs.

SUMMARY OF THE INVENTION

It is a principal object of the invention to provide a means for holding a capillary element in position in a writing instrument without disturbing capillary flow of ink therethrough. While there are no limitations with respect to the diameter of the capillary elements, the invention is particularly useful in securely holding fine diameter plastic nibs in the range of 0.5 to 3.0 millimeters in exposed writing position. The invention has been used with particularly good effect with nibs of a diameter of approximately 0.8 millimeters.

In accordance with the invention, a writing instrument has a hollow barrel which defines at its forward end thereof a passageway through which a nib or capillary element extends from an ink reservoir to an exposed writing position, the passageway being formed to have one portion arranged along the barrel axis and another portion offset from that axis to define an intermediate shoulder between the portions. The shoulder is a cam or deflecting means which functions to deflect the capillary nib so as to force the nib into frictional engagement with the inner wall of the passageway which holds the nib in proper operative position without disturbing its capillary flow of ink.

In one exemplary embodiment of the invention, a primary nib retaining adapter is fitted into the open end of the barrel. The adapter defines the passageway having the aforementioned offset portions and has an external surface which merges smoothly with the external surface of the barrel.

The passageway is configured so that one end affords a seat for receiving a nib holder which provides suitable support for the outer portion of the capillary element. The capillary element extends through an axial bore in the nib holder with the tip of the capillary element extending outward from the nib holder and functioning as the writing element.

DESCRIPTION OF THE PREFERRED EMBODIMENTS

Figure 1:
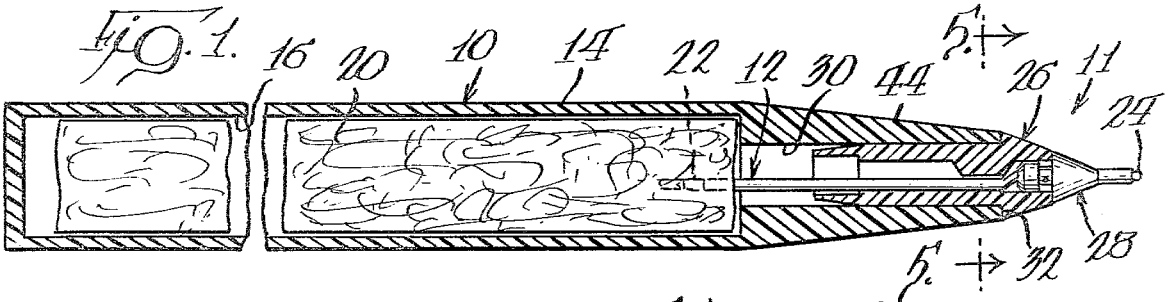
FIG. 1 is a broken longitudinal sectional view taken generally centrally along the axis of the writing instrument.

Referring to FIG. 1, a writing instrument is shown which includes a tubular body, generally designated 10, a nib retaining means, generally designated 11, and a capillary element or nib, generally designated 12.

The tubular body 10 includes a hollow, generally cylindrical, barrel 14 having an internal chamber 16 which affords an ink reservoir therewithin formed of well known absorbent fibrous filler material 20 which is capable of storing a large quantity of writing fluid, such as ink. The barrel 14 is preferably injection molded of plastic material.

The nib 12 is of a type well known in the art and is formed of a plastic material, for example, a material sold under the trade name "Delrin." The nib generally has a plurality of internal strands of plastic surrounded by an external sheath or cover to confine a multitude of longitudinally extending capillary conduits extending through the length of the nib. The elongate nib 12 is flexible, and it is preferably at least slightly resiliently flexible.

As shown here, the inner end 22 of the nib 12 is slightly tapered to expose the capillary passages, and this inner end 22 is impaled and positioned within the ink-soaked filler material 20. In other words, the inner end 22 has a portion of the covering sheath removed to expose more readily the inner ends of the capillaries to the ink supply of the reservoir.

A forward end 24 of the nib is rounded and terminates in a smooth external writing point. When the writing instrument is used, ink flows by capillary action from the ink reservoir through the internal capillaries of the nib 12 and to the forward writing end 24. Appropriate venting in the front end of the barrel or nib retaining means serves to equalize pressure within the writing instrument.

Figure 2:
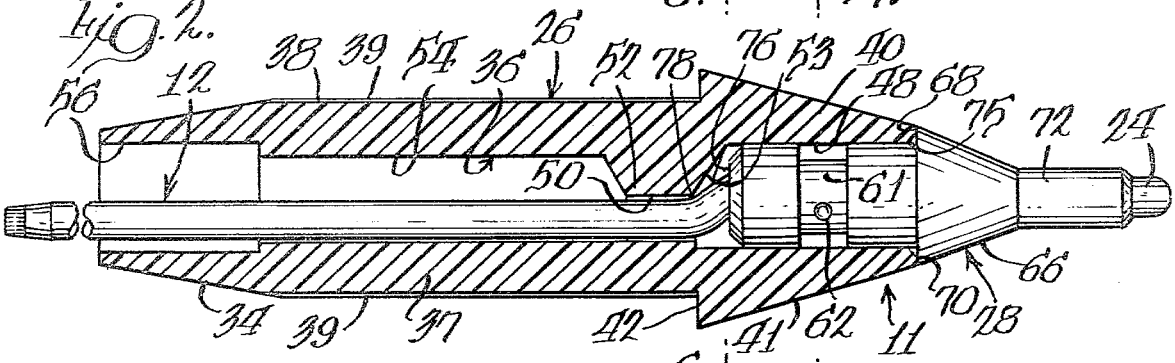
FIG. 2 is an enlarged broken longitudinal sectional view of the nib retaining assembly removed from the front portion of the barrel shown in FIG. 1.
Figure 3:
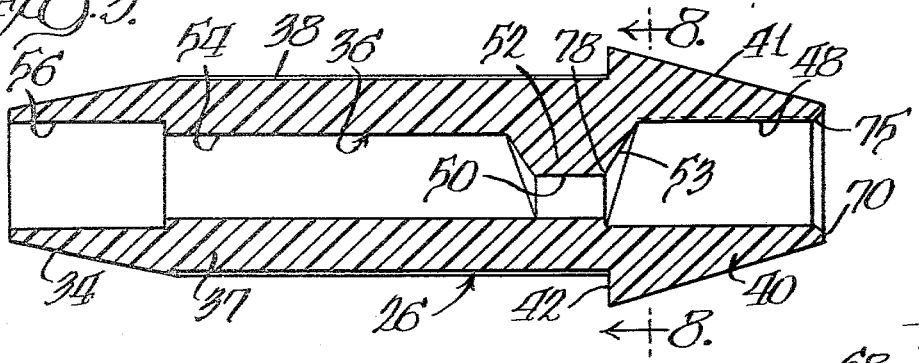
FIG. 3 is a longitudinal sectional view of the nib retaining adapter shown in FIG. 2 with the nib and nib holder removed.

Referring to FIG. 2, the nib retaining means or assembly 11 is shown removed from the barrel 14. This assembly includes a primary nib retainer or adapter, generally designated 26, a ferrule or nib holder, generally designated 28, and the nib 12. The nib retainer 26 may also be formed by injection molding from plastic and is shaped to be press-fitted axially into an annular outer bore 30 at the forward open end 32 of the barrel 14 so that the joint therebetween is tight. The beveled truncated surface 34 facilitates insertion of retainer 26 into the outer bore 30.

The nib retainer or adapter 26 has an internal passageway, generally designated 36, through which the nib 12 extends from its exposed forward writing end 24 to its inner end embedded in filler material 20. An inner portion 37 of adapter 26 has a cylindrical outer surface 38 which makes a close frictional fit with the annular inner wall defining the bore 30 of the barrel 14. Axially extending flats 39 preferably are formed circumferentially of the outer annular surface 38 and deform upon insertion of the adapter 26 to hold the adapter securely within the bore 30. The adapter 26 has an outer portion 40 having a frustoconical external surface 41 and an external annular shoulder 42 which abuts the annular end 32 of the barrel 14 to limit insertion of the adapter 26 therein. The frustoconical wall 41 is configured to blend evenly with the external surface 44 of the forward portion of the barrel 14.

Figure 7:
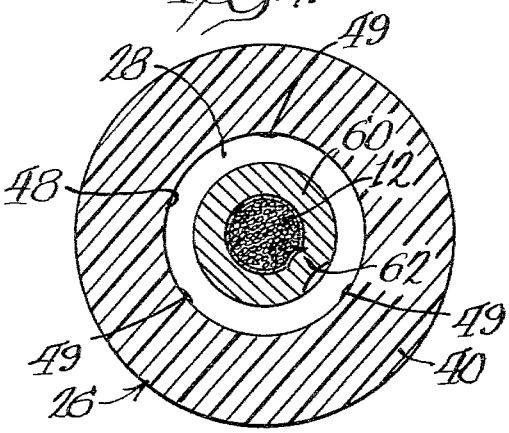
FIG. 7 is an enlarged cross-sectional view taken along line 7—7 of FIG. 2.

The passageway 36 through the nib retainer adapter includes a first portion in the shape of a cylindrical front bore 48 centered on the axis of adapter 26. As seen in FIG. 7, the wall of the bore 48 is provided with longitudinally extending, circumferentially spaced flats 49 which make a close friction fit with adjacent annular surfaces of the inserted end of nib holder 28.

As seen in FIG. 2, the passageway 36 of adapter 26 has a second portion in the shape of a rear bore 50, and the axis of bore 50 is laterally offset from the axis of adapter 26 to define an internal shoulder or abutment 52 which affords a deflecting or camming surface 53 for laterally deflecting an intermediate portion of nib 12. Thus a nib 12 inserted in passageway 36 will initially be deflected transversely of the axis of the barrel by the camming surface 53 of shoulder 52, and then the nib 12 will be redirected longitudinally of the axis of the barrel into the ink reservoir so that the nib 12 is positioned in a non-linear configuration, as shown in FIG. 2. The resilience and flexibility of the plastic nib 12 enhances the firm frictional holding engagement between the nib and the internal surfaces of the adapter 26.

Figure 5:
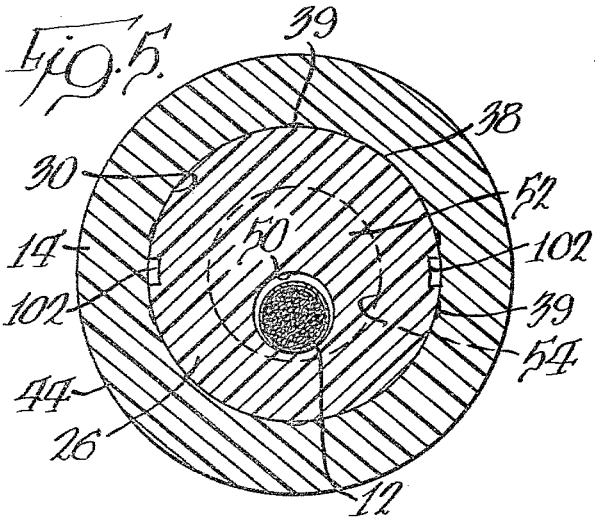
FIG. 5 is an enlarged cross-sectional view taken along line 5—5 of FIG. 1.
Figure 6:
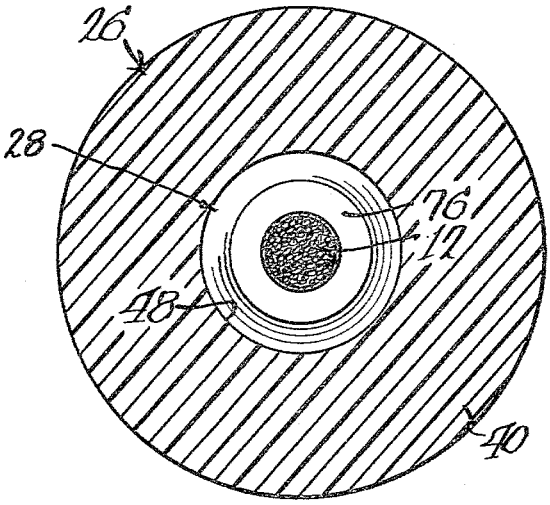
FIG. 6 is an enlarged cross-sectional view taken along line 6—6 of FIG. 2.
Figure 8:
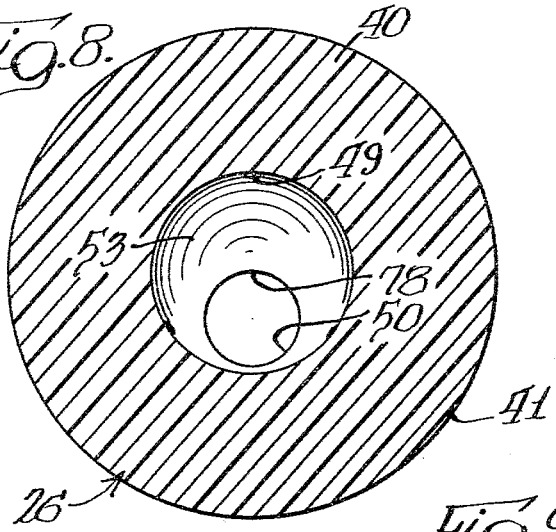
FIG. 8 is an enlarged cross-sectional view taken along line 8—8 of FIG. 3.

The axis of the rear bore 50 is preferably offset laterally of the axis of the front bore 48 by about 0.018 inch to accommodate and hold fine diameter nibs in the range of 0.5 mm. to 3.0 mm. This lateral offset in the nib 12 can best be seen by comparing the nib positions in FIG. 5 and FIG. 6.

The adapter 26 may also be provided with inner cylindrical 54 and counterbore 56, each disposed on the adapter axis. Their large diameter facilitates the injection molding process by which adapter 26 is preferably formed.

Figure 4:
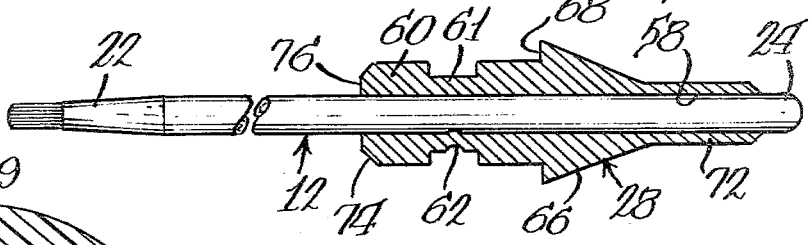
FIG. 4 is a broken longitudinal sectional view of the nib and nib holder removed from the nib retaining adapter of FIG. 3.

The nib holder 28 can best be seen in FIGS. 2, 4 and 7, and it is preferably made of a suitable metal material. The nib holder includes an axial bore 58 which closely embraces the outer end portion of the nib 12 as illustrated in FIG. 4. An inner portion 60 has longitudinally spaced annular supports which make a close frictional fit within front bore 48, as seen in FIG. 2 and FIG. 7, and intermediate annular portion 61 is staked at 62 (FIGS. 4 and 7) to hold the nib in assembled relation in the holder 28. It should be noted, however, that the nib holder 28 is understaked to hold the nib 12 in position under relatively light pressure thereby eliminating the possibility of disturbing the capillary action of ink passing through the nib 12. The stake 62 is not generally sufficient by itself to maintain the nib 12 in position under writing pressure. However, in some circumstances, it is possible with the present invention to eliminate the necessity of staking entirely.

The exposed outer portion of the nib holder 28 has a frustoconical surface 66 and an external annular shoulder 68 which abuts the forward end 70 of the adapter 26 and is shaped to blend evenly with the external surface 41 of the outer portion 40 of the adapter 26. A cylindrical outer portion 72 supports the writing portion of the nib 12.

In assembling the writing instrument a jig and fixture apparatus may be used to insert the nib 12 and the nib holder 28 into the outer bore 48 of the adapter 26 until the shoulder 68 of the nib holder 28 abuts the end 70 of the adapter 26. The beveled surfaces 74 and 75 facilitate insertion of the nib holder 28 into the outer bore 48 of the adapter 26. Appropriate pressure is thereby utilized to force the nib 12 into an offset angled position about the internal shoulder 52 so that the intermediate portion of the nib 12 is moved into a frictional fit with the adapter 26 to frictionally hold the nib 12 in proper position in relation to the nib assembly.

As best seen in FIG. 2, the depth of the adapter bore 48 between the end 70 and the shoulder 52 is more than the length of the inner portion 60 of the nib holder 28 so that when the nib holder 28 is inserted within the bore 48, the end 76 is spaced slightly from the shoulder 52. With a nib of 0.8 mm diameter, a spacing of about 0.028 inch has been found to be satisfactory in allowing the nib to curve around the shoulder 52 within the nib retainer 26. In any event, the nib 12 is directed around the shoulder 52, but is not required to make a sharp bend. Thus, the nib 12 is not constricted between the end 76 and the shoulder 52 to impinge and shut off the capillary flow of ink therethrough; and the bending of the nib 12 around the shoulder and the frictional contact against the wall of the bore 54 securely holds the nib 12 in position when writing pressure is applied to the writing point 24. The edge or corner 78 of shoulder 52 is generally broken down or rounded off by the lateral surface of the nib 12 during the assembly operation.

Figure 10:
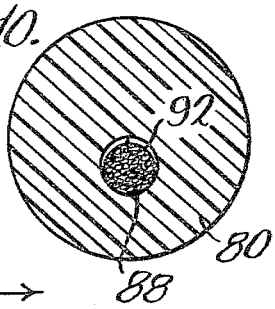
FIG. 10 is an enlarged cross-sectional view taken along line 10—10 of FIG. 9.
Figure 9:
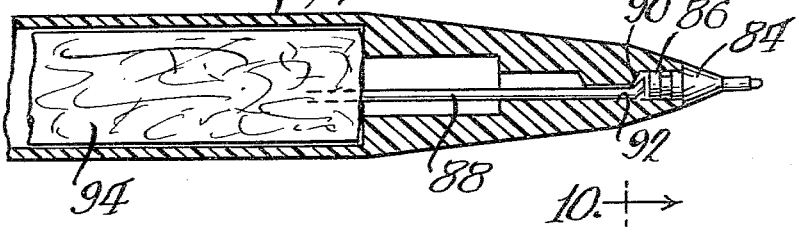
FIG. 9 is an enlarged cross-sectional view of a second embodiment of the invention illustrating the nib retaining means formed integrally with the barrel.

FIGS. 9 and 10 show another embodiment of a writing instrument constructed in accordance with the invention in which the nib retaining means 26 is integrally formed in the barrel 80. In this manner, the separate retaining adapter is eliminated. The nib holder 84 is inserted into the passage outer portion 86 which is formed along the barrel axis. The capillary element 88 extends rearwardly about the shoulder 90 and through the passage offset portion 92 into the ink saturated filler material 94.

Figure 11:
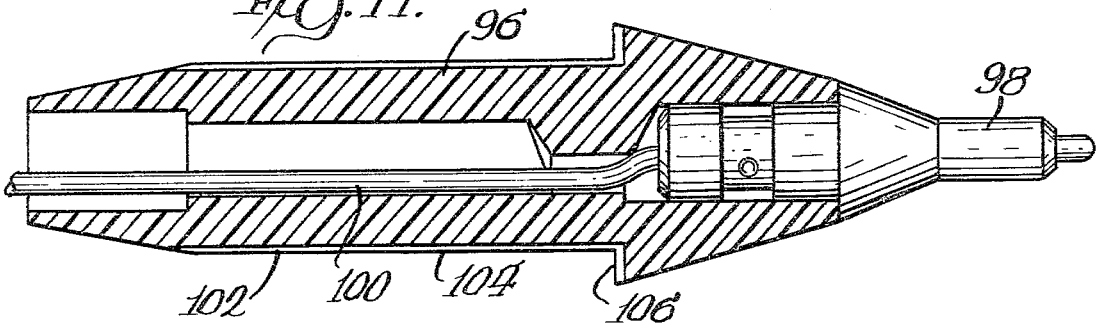
FIG. 11 is an enlarged longitudinal sectional view similar to FIG. 2 of the nib retaining assembly, but utilizing a capillary nib of smaller diameter.

In FIG. 11, an adapter 96, similar to the adapter 26 shown in FIG. 2, is utilized with a nib holder 98 which holds a capillary element 100 that has a diameter less than that of the capillary element 12 shown in FIGS. 1–6. While the diameter of the bore of the nib holder 98 is reduced, the remainder of the nib retaining means remains substantially unchanged. Thus a single nib retaining means is capable of accommodating a plurality of nibs of differing diameters. Further illustrated are narrow channels 102 defined in the cylindrical outer wall 104 and shoulder 106 of the adapter 96 which permits pressure within the ink reservoir to be equalized with atmospheric pressure.

I claim:

1. A writing instrument, comprising: an elongated hollow barrel having an internal chamber and a front end portion shaped to afford a forwardly opening annular seat, the barrel being provided with a longitudinal passageway extending between the chamber and the annular seat and having a transversely extending portion extending into the passageway to form an abutment having a forwardly facing, rearwardly inclined surface, the abutment being positioned rearwardly of the seat and partially obstructing said longitudinal passageway to afford a smaller constricted passageway; an elongate reservoir of absorbent material positioned in the chamber of the barrel to receive a quantity of writing fluid; a separable nib holder having a longitudinal nib-supporting bore therethrough and an inner body portion shaped to frictionally fit within the annular seat, the inner body portion and the bore being positioned in longitudinal alignment with said abutment and the inner ends of the body portion and bore being closely spaced from the abutment when the nib holder is fully seated in the annular seat; and an elongate flexible plastic nib extending through the bore of the nib holder and being deflected by the abutment surface through the constricted passageway into the reservoir in the barrel without any cutting or splitting of said nib by the abutment, the nib having an outer end portion provided with a writing end exposed forwardly of the nib holder, an inner end portion extending through the constricted passageway to the reservoir for receiving writing fluid, and an intermediate portion positioned against said abutment and between said abutment and said inner end of said inner body portion to prevent movement of the nib inwardly of the passageway when the nib holder is fully seated in the annular seat of the barrel, the axes of said outer and inner end portions being in laterally offset relation and the axis of the intermediate portion extending transversely of the axes of said outer and inner end portions, the constricted passageway having a cross-section of a size to accommodate a plurality of nib sizes with a single barrel structure.

2. A writing instrument as specified in claim 1, in which the nib is resiliently flexible and the inner end portion of the nib extending rearwardly through the passageway of the barrel frictionally engages the barrel to augment the securement of the nib in writing position.

3. A writing instrument as specified in claim 2, in which the abutment has a free end having an angular shoulder, said shoulder being positioned to bear against the nib between the intermediate portion and the inner end portion.

4. A writing instrument as in claim 1, in which the nib holder has a shoulder bearing against the front end portion of the barrel when the nib holder is fully seated in the annular barrel seat to afford the spacing for the nib intermediate portion.

5. In a writing instrument having an elongated hollow barrel provided with an internal chamber to receive an elongated reservoir of absorbent material for a quantity of writing fluid, the barrel being closed at one end portion and open at the other end portion to afford an annular barrel seat, a nib retaining assembly, comprising: an adaptor member shaped to frictionally fit within said barrel seat, the adaptor member having a longitudinal passageway therethrough opening into the barrel chamber and being shaped at its forward end to afford an adaptor seat, said adaptor member further having a transversely extending abutment positioned rearwardly of said adaptor seat and partially obstructing said passageway to form a smaller constricted passageway, the abutment having a forwardly facing, rearwardly inclined surface; a separable nib holder having a longitudinal nib-supporting bore therethrough and an inner body portion shaped to frictionally fit within the adaptor seat, the inner body portion and the bore each being positioned in longitudinal alignment with the abutment of the adaptor member and each having an inner end closely spaced from the abutment when the nib holder is fully seated in the adaptor seat; and an elongate flexible plastic nib extending through the bore of the nib holder and being deflected by the abutment surface through the constricted passageway of the adaptor into the reservoir of the barrel without any cutting or splitting of said nib by the abutment, the nib having an outer end portion provided with a writing end exposed forwardly of the nib holder, an inner end portion extending through the constricted passageway to the reservoir for receiving writing fluid, and an intermediate portion positioned against said abutment and between said abutment and the inner end of said body portion to prevent movement of the nib inwardly of the passageway when the nib holder is fully seated in the adaptor seat, the axes of said outer and inner end portions being in laterally offset relation and the axis of the intermediate portion extending transversely of the axes of said outer and inner end portions, the constricted passageway having a cross-section of a size to accommodate a plurality of nib sizes with a single adaptor member.

6. A nib retaining assembly as specified in claim 5, in which the nib is resiliently flexible and the inner end portion of the nib extending rearwardly through the constricted passageway frictionally engages the adaptor to augment the securement of the nib in writing position.

7. A nib retaining assembly as specified in claim 6, in which the abutment has a free end having an angular shoulder, said shoulder being positioned to bear against the nib between the intermediate portion and the inner end portion.

8. The nib retaining assembly as specified in claim 5, in which the nib holder has a shoulder bearing against the forward end of the adaptor member when the nib holder is fully seated in the adaptor seat to afford the spacing for the nib intermediate portion.

9. The nib retaining assembly as in claim 5 in which the nib holder is lightly staked to the portion of the nib extending through the bore to hold the nib and nib holder together during assembly into the adaptor member.

10. The nib retaining assembly as in claim 5 in which the cross-sectional width of the nib is in the range of 0.5 mm to 3.0 mm.

11. The nib retaining assembly as in claim 5 in which the cross-sectional width of the nib is in the range of 0.5 mm to 1.0 mm.

* * * * *